US012122573B2

(12) United States Patent
Defert

(10) Patent No.: US 12,122,573 B2
(45) Date of Patent: Oct. 22, 2024

(54) ASSEMBLY FOR CLOSING A TUBE AND TUBE COMPRISING THIS ASSEMBLY

(71) Applicant: ALBEA SERVICES, Gennevilliers (FR)

(72) Inventor: Sylvain Defert, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 2 days.

(21) Appl. No.: 17/617,247

(22) PCT Filed: Jun. 3, 2020

(86) PCT No.: PCT/EP2020/065394

§ 371 (c)(1),
(2) Date: Dec. 7, 2021

(87) PCT Pub. No.: WO2020/245228

PCT Pub. Date: Dec. 10, 2020

(65) Prior Publication Data

US 2022/0234800 A1 Jul. 28, 2022

(30) Foreign Application Priority Data

Jun. 7, 2019 (FR) ..... 1906118

(51) Int. Cl.
*B65D 51/22* (2006.01)
*B65D 35/44* (2006.01)

(52) U.S. Cl.
CPC ..... *B65D 51/222* (2013.01); *B65D 35/44* (2013.01)

(58) Field of Classification Search
CPC ..... B65D 51/222; B65D 35/44
(Continued)

(56) References Cited

U.S. PATENT DOCUMENTS 3,339,812 A * 9/1967 Meissner ..... B65D 51/222 222/541.2
7,540,405 B2 * 6/2009 Sase ..... B65D 5/748 229/125.14

(Continued)

FOREIGN PATENT DOCUMENTS

EP 1686066 8/2006
FR 3086929 * 10/1918

(Continued)

OTHER PUBLICATIONS

EP20729092.5, "Communication Pursuant to Article 94(3) EPC", with Machine Translation, May 7, 2024, 10 pages.

*Primary Examiner* — Paul R Durand
*Assistant Examiner* — Michael J. Melaragno
(74) *Attorney, Agent, or Firm* — Kilpatrick Townsend & Stockton LLP

(57) ABSTRACT

The invention relates to an assembly for closing a tube, said assembly comprising a tube head (3) that has a neck (10) and a closing cover (5) for closing said neck (10), the assembly further comprising a cap (30) which is provided with a piercing element (7) designed to perforate said closing cover (5), the neck (10) and cap (30) being configured such that the cap (30) is guided into a closed position in which said piercing element (7) has perforated the closing cover (5), said piercing element comprising one or more teeth (50) for cutting through the closing cover (5), which extend from a free edge (80) of the piercing element (7), at least one angular portion (81) of said free edge (80), referred to as the passage portion, being configured to remain in the neck (10) when in said closed position.

10 Claims, 9 Drawing Sheets

(58) Field of Classification Search
USPC ..... 222/81, 80, 83, 83.5; 220/258.4, 277, 220/278; 215/257
See application file for complete search history.

(56) References Cited

U.S. PATENT DOCUMENTS

| | | | | |
|---|---|---|---|---|
| 7,757,892 | B2 * | 7/2010 | Berman | B65D 5/748 222/91 |
| 8,944,271 | B2 * | 2/2015 | Seguin | B65D 51/225 220/258.4 |
| 10,370,162 | B2 * | 8/2019 | Defert | B65D 35/44 |
| 10,710,777 | B2 * | 7/2020 | Costa | B65D 5/748 |
| 10,717,568 | B2 * | 7/2020 | Defert | B65D 51/222 |
| 2007/0289937 | A1 * | 12/2007 | Kaneko | B65D 5/748 215/252 |
| 2016/0194122 | A1 * | 7/2016 | Kerman | B65D 35/44 215/253 |
| 2017/0297783 | A1 * | 10/2017 | Defert | B65D 35/44 |
| 2017/0297788 | A1 * | 10/2017 | Defert | B65D 41/02 |
| 2022/0234800 | A1 * | 7/2022 | Defert | B65D 51/222 |

FOREIGN PATENT DOCUMENTS

| | | | | |
|---|---|---|---|---|
| FR | 3086929 | A1 * | 4/2020 | B65D 47/0838 |
| LU | 88845 | | 6/1998 | |
| WO | 2010128302 | A1 | 11/2010 | |

* cited by examiner

[Fig. 1]
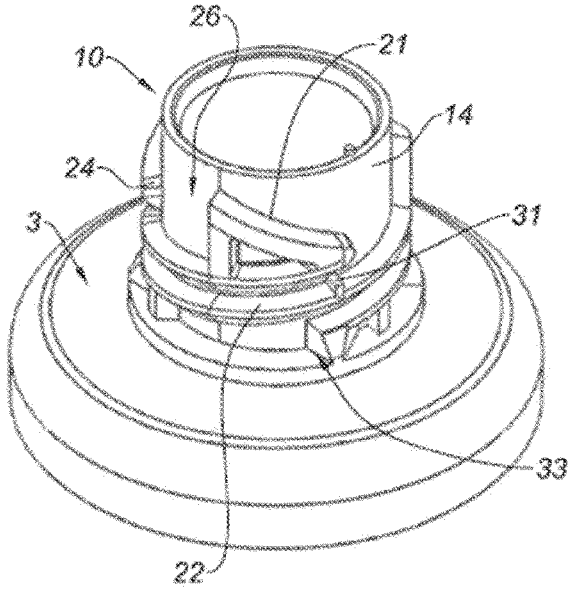
[Fig. 2]
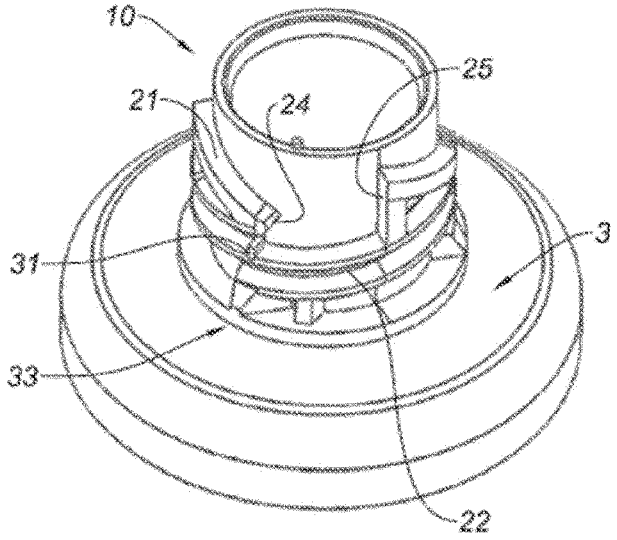

[Fig. 3]
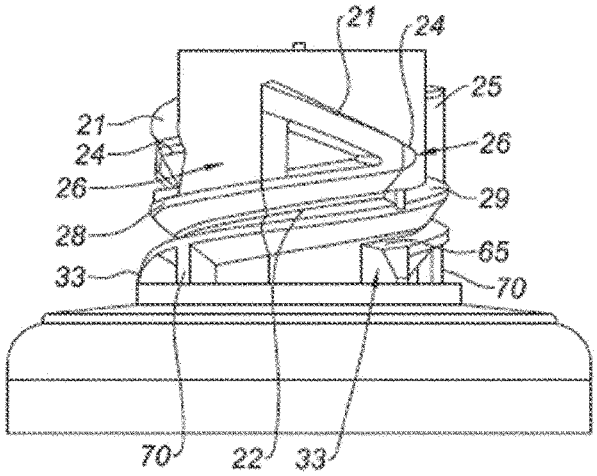
[Fig. 4]
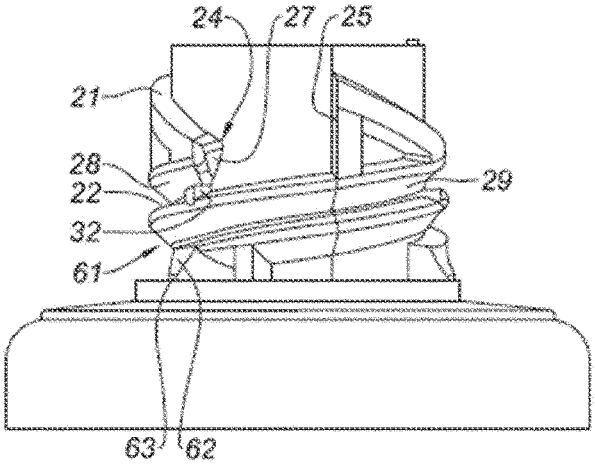

[Fig. 5]
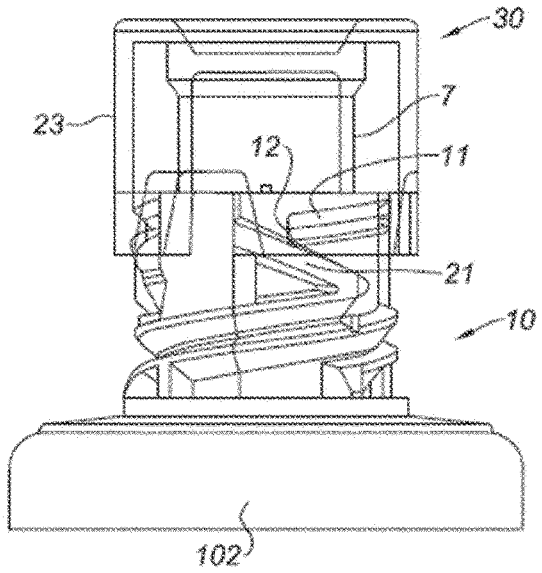
[Fig. 6]
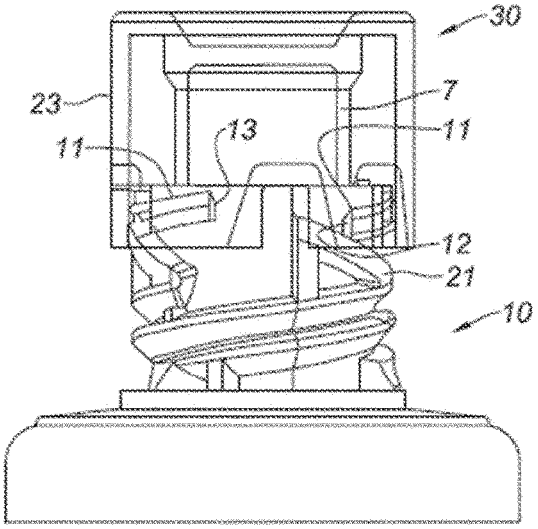

[Fig. 7]
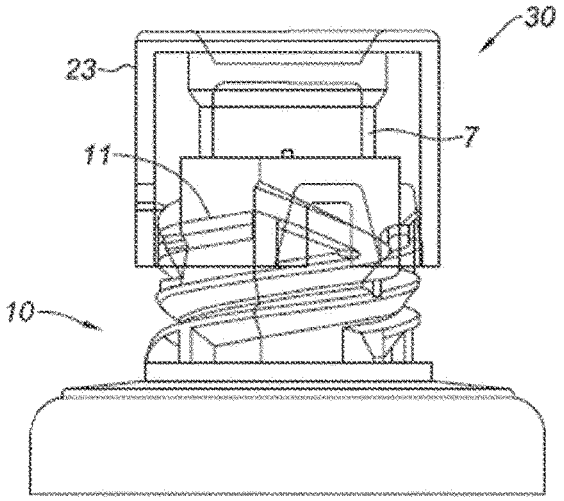
[Fig. 8]
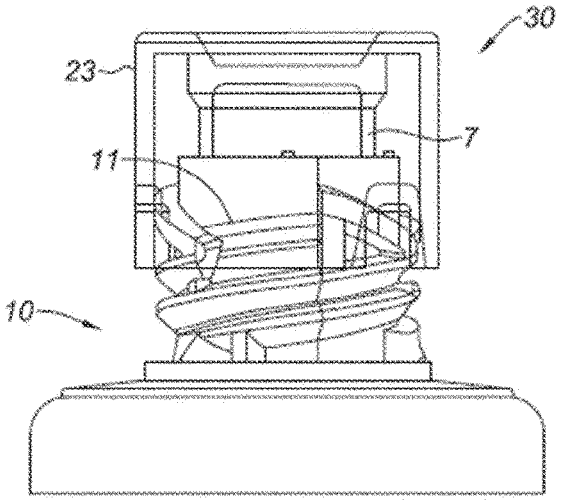

[Fig. 9]
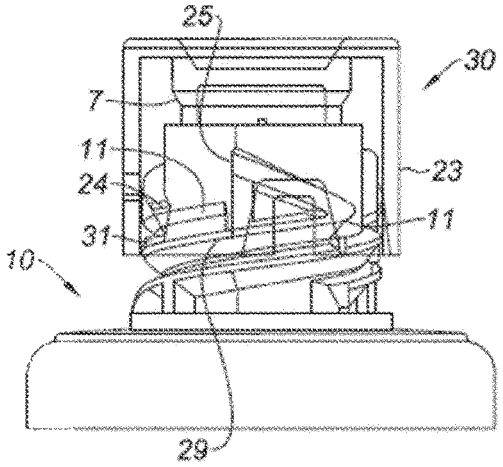
[Fig. 10]
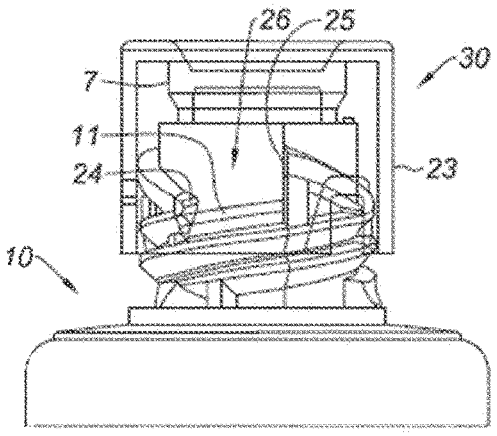
[Fig. 11]
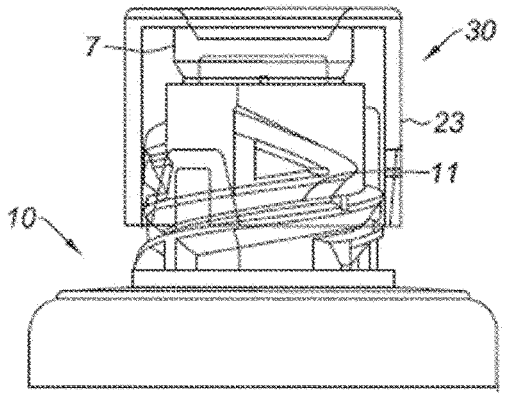

[Fig. 12]
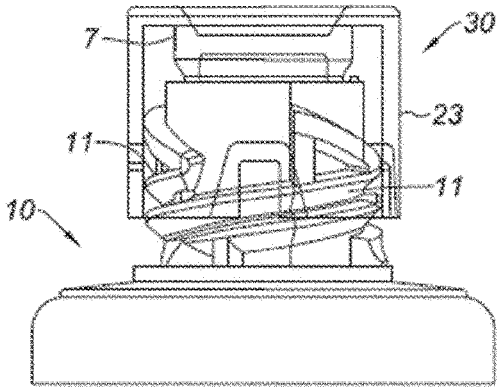
[Fig. 13]
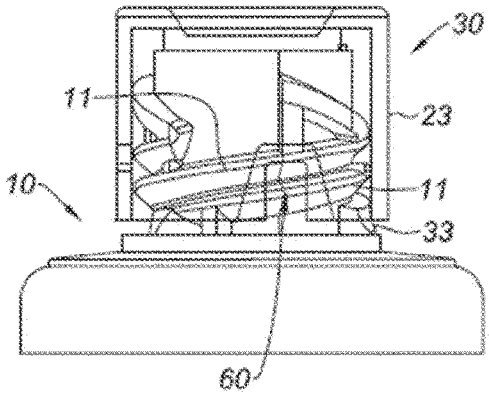
[Fig. 14]
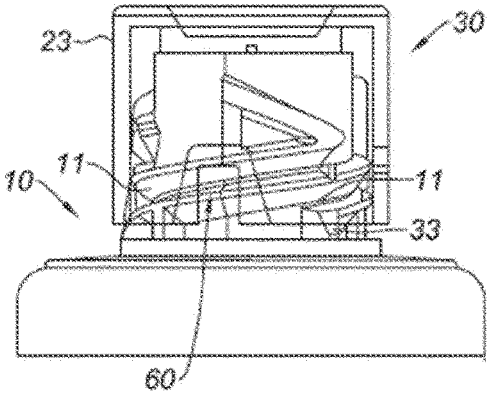

[Fig. 15]
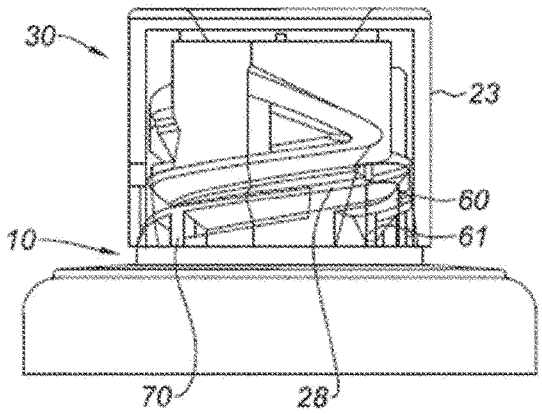
[Fig. 16]
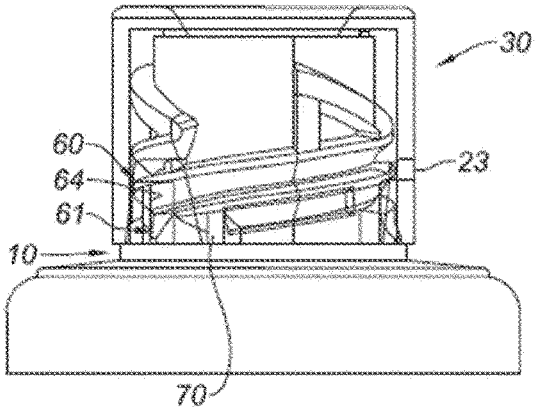

[Fig. 17]
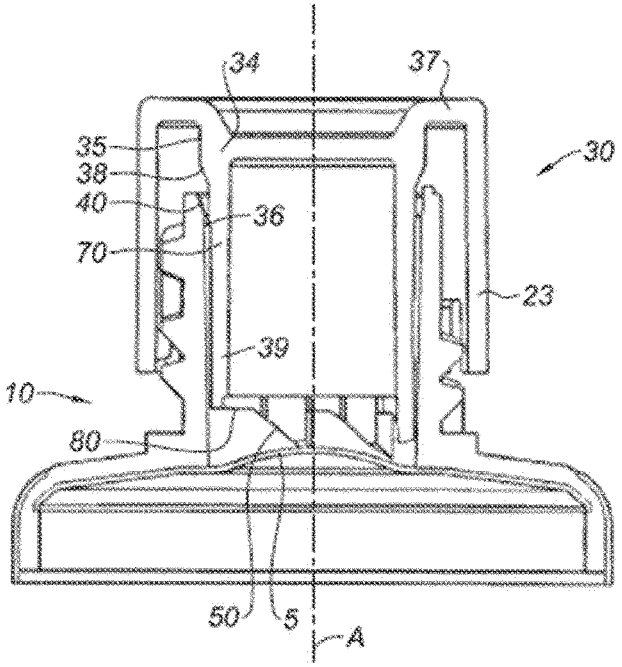
[Fig. 18]
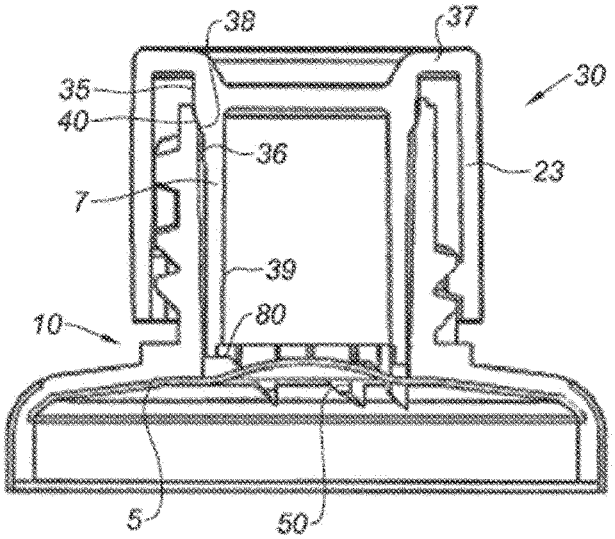

[Fig. 19]
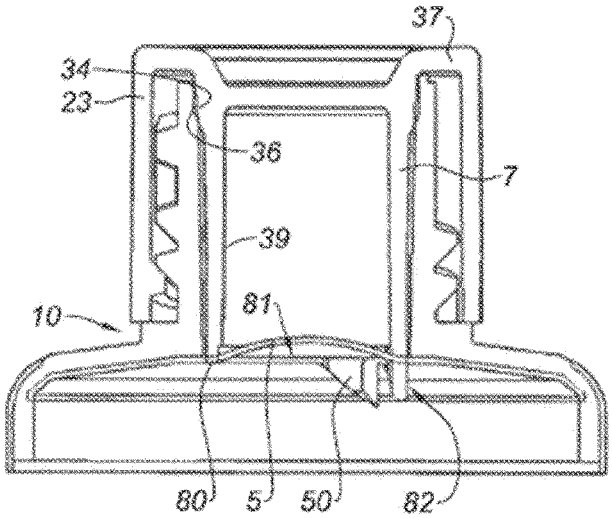
[Fig. 20]
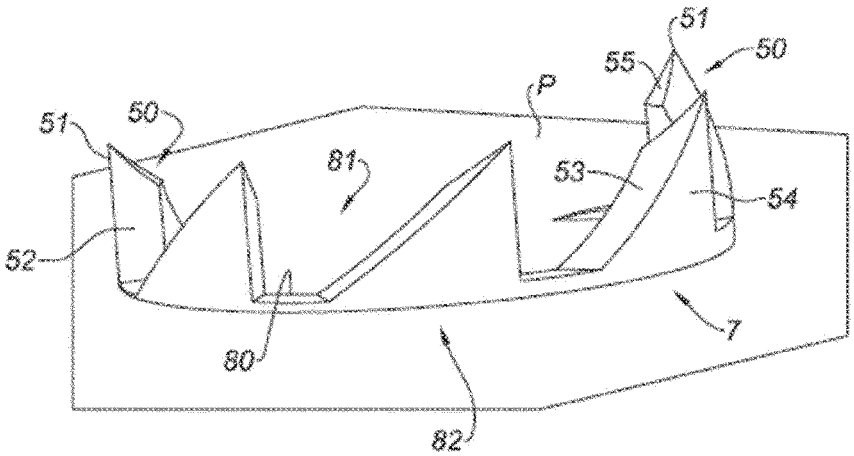

ASSEMBLY FOR CLOSING A TUBE AND TUBE COMPRISING THIS ASSEMBLY

CROSS-REFERENCE TO RELATED APPLICATIONS

This application is a § 371 national phase entry of International Application No. PCT/EP2020/065394, filed Jun. 3, 2020, which claims priority to French Patent Application No. 1906118, filed Jun. 7, 2019.

The present invention relates to an assembly for closing a tube and tube comprising this assembly.

Tubes are known which are provided with a lid and associated with a perforating cap comprising a punch adapted to perforate said lid.

The lid allows the product contained in the tube to be kept hermetically sealed during its storage prior to its first use, which represents a very important part of the overall service life of the tube.

There are caps in which the punch is arranged in the cap and protrudes from it so that it can perforate the lid when the cap is screwed onto the tube head. In order to ensure the preservation of the lid prior to the first use, a ring is placed between the cap and a shoulder of the tube head, so as to keep the punch away from the lid when the cap is screwed on the neck. In this position, the cap is in position referred to as transport position or waiting position before the first use.

To pierce and/or cut the lid, the user must first unscrew the cap, then remove the ring and finally screw the cap back on until the lid is pierced and/or cut once it has reached an end of stroke position, also called closing position. The number of steps is restrictive for the user who often does not understand what the ring is for and does not necessarily understand that a lid must be pierced before the tube is used for the first time.

It is known from the document LU 88845 that a cap is provided with a punch which is held in waiting position without a removable ring. The neck comprises a housing in which a thread portion, located on the cap, can be blocked in such a position. The thread portion is then used to screw the cap onto the neck to a position that allows the lid to be pierced and cut off when the tube is first used. The cap can then be screwed or unscrewed for later use or left in place when equipped with a re-sealable service cap dispensing system. However, there are various disadvantages to this device.

First of all, the cap is positioned on the neck in waiting position using methods that operate at a very high rate. It is therefore necessary that this operation can be done with high reliability in order to provide satisfactory repeatability.

With the device of the document LU 88845, a rib serving to snap-fit the thread portion into the housing allowing it to be held in waiting position is carried out by radial deformation of the cap. The manufacturing tolerances remain relatively high, typically greater than a tenth of a millimeter, in such a direction, which is detrimental to an ability to obtain the desired blocking effect on all the caps produced, particularly in the case of demolding with sliders.

To overcome this first disadvantage, the present invention proposes, according to a first aspect, an assembly for closing a tube, said assembly comprising a tube head that has a neck, and a cap, said assembly defining a guide path, a threading and a thread portion allowing the cap to be positioned on the neck by cooperation with the guide path and the threading, said assembly comprising a first and a second stops for said thread portion, said stops being angularly spaced apart and defining a passage between the guide path and the threading, said assembly being configured to allow axial displacement of the thread portion through the passage with a non-return effect produced by at least one of said stops.

According to this first aspect of the invention, the stops allowing the cap to be positioned at the desired location while preventing its return to the previous configuration, in particular a configuration in which the cap can be disconnected from the neck, are angularly positioned with respect to each other. In this way, the span of the corresponding passage can be controlled more precisely, particularly in the case of a cap and a neck demolded with sliders. This provides a manufacturing method with improved repeatability.

According to this first aspect, the invention may also comprise any of the following characteristics, taken individually or in any technically possible combination forming as many embodiments of the invention, this comprising with the characteristics of the other aspects of the invention set forth below:

- said tube head is further provided with a lid closing said neck,
- said cap is provided with a punch adapted to perforate said lid,
- said neck and said cap are configured to guide the cap from an initial position in which the cap is not engaged with the neck to a waiting position in which the punch is held at a distance from said lid, in particular after the thread portion has passed through said passage, and then from said waiting position to a closing position in which said punch has perforated said lid,
- said guide path allows the passage from the initial position to the waiting position and said threading allows the passage from the waiting position to the closing position,
- one of the two between the guide path and the threading induces a screwing in a clockwise direction of rotation of the cap, the other of the two between the guide path and the threading inducing a screwing in a counterclockwise direction of rotation of the cap,
- the guide path induces a counterclockwise rotation of the cap and the threading induces a clockwise rotation of the cap,
- the neck comprises the guide path and the threading and the cap comprises the thread portion,
- the first stop forms one end of said guide path,
- said assembly comprises a shoulder connecting an origin of a first thread of the threading and the first stop,
- the second stop is formed by an axial partition,
- the second stop forms the origin of a second thread of the threading,
- said assembly comprises a third stop configured to block a screwing of the cap after positioning the cap on the neck,
- said third stop comprises a wall, extending transversely from a bottom partition of the threading,
- said wall extends axially partially through said threading,
- an angular extension between the second and the third stop is just greater than an angular extension of the thread portion.

Another disadvantage of the device of the document LU 88845 is the torque required to successfully close the cap on the first use. In fact, with the cap used in this document, it is necessary to simultaneously pierce the lid and compress a seal ensuring a tight closure of the cap. Such a torque may cause discomfort to the user.

To overcome this other disadvantage, the present invention proposes, according to a second aspect, an assembly for closing a tube, said assembly comprising a tube head that has a neck and a lid closing said neck, said assembly further comprising a cap provided with a punch adapted to perforate said lid, said neck and said cap being configured so as to guide the cap over the neck to a closing position in which the cap has perforated the lid, by passing through an intermediate position in which the punch has finished piercing said lid, as well as to cause a deformation of the material sealing the closure, said assembly being configured so that the passage through the intermediate position takes place prior to the deformation of the material sealing the closure.

Material deformation means, for example, a material crushing or the like which causes a seal. According to this second aspect of the invention, by sequencing the operations corresponding on the one hand to the piercing and on the other hand to the compression of the material allowing to make the closure tight, a configuration is obtained in which the torque to be exerted is more constant throughout the positioning of the cap on the neck, which is more comfortable for the user. The deformation of the sealing material only takes place once the piercing of the lid has been completed. In other words, during the deformation used for sealing, a cut in the lid can take place at the same time, but its piercing took place beforehand. In particular in the case of a punch provided with a plurality of teeth, all the teeth have pierced said lid.

According to this second aspect, the invention may also comprise any of the following characteristics, taken individually or in any technically possible combination forming as many embodiments of the invention, this comprising with the characteristics of the other aspects of the invention set forth herein or thereafter:

- the cap is screwed onto the neck during the passage through the intermediate position and up to the closing position,
- said neck and said cap are configured to guide the cap from an initial position in which the cap is not engaged with the neck to a waiting position in which the punch is held away from the lid, and then from said waiting position to said closing position, in particular by screwing,
- said cap and said neck are configured so that said intermediate position is located downstream of the waiting position along the direction of guiding the cap to the closing position,
- said assembly comprises a thread portion and a threading for screwing the cap onto the neck,
- said assembly comprises a stop configured to block the screwing of the cap in said waiting position, said assembly being configured so that said thread portion has passed said stop before the piercing of the lid begins,
- said assembly further comprising a non-return stop configured to prevent the cap from moving out of the closing position, said assembly being configured so that said stop is passed after passing into an intermediate position,
- the punch comprises a plurality of teeth, said intermediate position being the position occupied by the punch when all the teeth have pierced said lid,
- said punch comprises a base having an outer cylindrical portion and said neck comprises an inner cylindrical portion,
- said inner and outer cylindrical portions are intended to be crushed against each other to achieve the sealing of said closure,
- said cap comprises a top from which said base of the punch extends, said punch comprising an external chamfer extending from said base and connected to a distal part of the punch,
- said portion of the neck against which the base of the punch is intended to be crushed is located in the axial extension of a chamfer, located at an opening end of the neck,
- said distal part of the punch has an outer diameter smaller than an inner diameter of the neck.

According to another disadvantage of the device of the document LU 88845, the cap comprises a non-return stop allowing the cap to be held in place once in the closing position. However, this stop is located in the threading used to guide the cap on the neck and the thread portion used to screw the cap must pass over this stop with force. This may damage said stop and requires an additional torque to be applied by the user. This stop can also give the user the impression of a hard point corresponding to an end of stroke marking the closing of the cap when this is not yet the case. The perforation of the lid by the punch may not be completed, which will hinder the proper flow of the product contained in the tube. There is also a risk that the seal may not be completely tight.

To overcome this other disadvantage, the present invention proposes, according to a third aspect, an assembly for closing a tube, said assembly comprising a tube head that has a neck and a lid closing said neck, said assembly further comprising a cap provided with a punch adapted to perforate said lid, said neck and said cap being configured to guide the cap to a closing position in which said punch has perforated said lid, said cap comprising a lateral skirt provided with at least one notch opening radially, said neck comprising a protrusion configured to cooperate angularly with said notch to block the withdrawal of the cap, once said cap is in said closing position.

According to this third aspect of the invention, the protrusion allowing to block the cap in the closing position does not come into contact with the shapes used to guide the cap to its closing position. Instead, it is located at a distance and cooperates with a specific shape, namely the notch provided in the cap to operate the desired blocking. This prevents damage to the shapes used to guide the cap on the neck and ensures that the correct end stroke position is identified. According to this third aspect, the invention may also comprise any of the following characteristics, taken individually or in any technically possible combination forming as many embodiments of the invention, this comprising with the characteristics of the other aspects of the invention set forth herein or thereafter:

- said notch is open at a free edge of said skirt so as to impart radial resilience to the cap in the vicinity of said notch,
- said protrusion is configured to radially spread said skirt before the cap arrives in the closing position,
- said protrusion has an edge provided with an inclined portion and a straight portion, said inclined portion being configured to radially spread said cap and said straight portion being located at the level of a part of the protrusion forming a non-return stop for the cap once in closing position,
- said assembly comprises a threading and a thread portion configured to cooperate with said threading for screwing the cap to said closing position, said assembly is configured so that said thread portion reaches said closing position by passing away from said protrusion, said protrusion extends axially from a terminal end of a lower thread of the threading, said assembly further comprises an end of stroke stop for the cap in the closing position, the end of stroke stop is configured to cooperate with said thread portion, once said protrusion is engaged in one of said notches, said assembly comprises a plurality of said notches and a plurality of said thread portions, each of said thread portions being angularly located between two adjacent ones of said notches, said cap comprises a service cap.

According to another disadvantage of the device of the document LU 88845, the punch projects into the interior of the receptacle in closing position of the cap. This limits the restitution rate of the product. Indeed, the product in the receptacle at the level of the punch is blocked by the latter and cannot penetrate into the neck.

To overcome this other disadvantage, the present invention proposes, according to a fourth aspect of the invention, an assembly for closing a tube, said assembly comprising a tube head that has a neck and a lid closing said neck, said assembly further comprising a cap provided with a punch adapted to perforate said lid, said neck and said cap being configured to guide the cap to a closing position in which said punch has perforated said lid, said punch comprising one or more teeth for cutting the lid extending from a free edge of the punch, at least one angular portion of said free edge, referred to as passage portion, being configured to remain in the neck in said closing position.

According to this fourth aspect of the invention, an angular portion of the punch does not penetrate into the tube and therefore nothing opposes the flow of the product which can thus be more completely distributed.

According to this fourth aspect, the invention may also comprise any of the following characteristics, taken individually or in any technically possible combination forming as many embodiments of the invention, this comprising with the characteristics of the other aspects of the invention set forth herein or thereafter:

said passage portion of the free edge of the punch is flush with a lower end of the neck, said teeth are distributed over an angular portion of the punch, referred to as cutting portion, delimited by two of said teeth located angularly on either side of said cutting portion, said passage edge being formed by an angular portion of the punch complementary to said cutting portion, said teeth have tops that are axially offset from each other, the axial offset of the tops of the teeth is increasing in a direction of displacement of the cap towards said closing position, said teeth have a substantially identical height and extend axially from an angular portion of the free edge having an axial offset from one tooth to the other, said teeth have a substantially identical profile, said lid is located in the lower part of the neck, said cap is screwed onto said neck over at least a part of its stroke, said cap comprises a service cap.

It should also be noted that, according to another aspect, the invention concerns an assembly for closing a tube, said assembly comprising a tube head provided with a neck and a lid closing said neck, said assembly further comprising a cap provided with a punch adapted to perforate said lid, said neck and said cap being configured to guide the cap to a closing position in which said punch has perforated said lid, said punch comprising a plurality of teeth for cutting the lid extending from a free edge of the punch, said teeth having tops axially offset from each other, said teeth having a substantially identical height and extending axially from an angular portion of the free edge having an axial offset from one tooth to the other.

According to this aspect of the invention, an axial offset of the top of the teeth is achieved without having to use smaller and therefore more fragile teeth than others.

The invention also relates to a tube comprising a closure assembly as described above.

Further characteristics, purposes and advantages of the invention will be apparent from the following description, which is purely illustrative and non-limiting, and which should be read in conjunction with the appended drawings, in which:

FIG. 1 is a perspective view of a tube head for an assembly for the tube closing according to a first embodiment of the invention, from a first viewing angle, FIG. 2 is a perspective view of the tube head of FIG. 1 from another viewing angle, FIG. 3 is a side view of the tube head of FIG. 1 from the first viewing angle, FIG. 4 is a side view of the tube head of FIG. 1 from the other viewing angle, FIG. 5 is a side view of an assembly according to the invention comprising the head of FIG. 1 and a cap illustrated in transparency, according to the first viewing angle, in a first position of the cap, FIG. 6 is a side view of the assembly of FIG. 5 from the other viewing angle, in the first position of the cap, FIG. 7 is a side view of the assembly according to FIG. 5, from the first viewing angle, in a second position of the cap, FIG. 8 is a side view of the assembly according to FIG. 5, from the other viewing angle, in the second position of the cap, FIG. 9 is a side view of the assembly according to FIG. 5, from the first viewing angle, in a third position of the cap, FIG. 10 is a side view of the assembly according to FIG. 5, from the other viewing angle, in the third position of the cap, FIG. 11 is a side view of the assembly according to FIG. 5, from the first viewing angle, in a fourth position of the cap, FIG. 12 is a side view of the assembly according to FIG. 5, from the other viewing angle, in the fourth position of the cap, FIG. 13 is a side view of the assembly according to FIG. 5, from the first viewing angle, in a fifth position of the cap, FIG. 14 is a side view of the assembly according to FIG. 5, from the other viewing angle, in the fifth position of the cap, FIG. 15 is a side view of the assembly according to FIG. 5, from the first viewing angle, in a sixth position of the cap, FIG. 16 is a side view of the assembly according to FIG. 5, from the other viewing angle, in the sixth position of the cap, FIG. 17 is a diametrical cross-sectional view of the assembly according to FIG. 5 in the fourth position of the cap, FIG. 18 is a diametrical cross-sectional view of the assembly according to FIG. 5 in the fifth position of the cap, FIG. 19 is a diametrical cross-sectional view of the assembly according to FIG. 5 in the fifth position of the cap, FIG. 20 is a perspective view of a distal edge of a punch of the cap of the assembly of FIG. 5, the orientation of the cap having been reversed from the previous figures.

As illustrated in FIGS. 1 to 19, the invention relates to an assembly for closing a tube, in particular a flexible tube.

Said assembly comprises a tube head 3 and a cap 30. The tube head 3 comprises a neck 10 and a lid 5 closing said neck 10, here in the lower part of the latter. In other words, the lid is disposed at the end of the neck in fluid communication with the reservoir of the tube. The cap 30 comprises a punch 7 adapted to perforate said lid 5. Said punch 7 is in particular configured to pierce and then cut said lid 5. Advantageously, said lid is only partially cut so that it remains attached to the tube head 3 by a portion of material.

The neck 10 and the cap 30 extend substantially along a longitudinal axis A (see FIG. 17) passing through their center. In the following, "axial" is understood to mean oriented parallel to said longitudinal axis A. The cap 30 is movable in rotation and/or in translation with respect to said neck 10 along said longitudinal axis A.

Said neck 10 and said cap 30 are configured to allow the cap 30 to be guided, in particular, from an initial position, illustrated in FIGS. 5 and 6, to a waiting position, illustrated in FIGS. 9 and 10, and then from said waiting position to a closing position, illustrated in FIGS. 15 and 16.

When the cap 30 is in its initial position, said cap 30 is not in engagement with the neck 10. Said cap 30 is in this initial position at the beginning of the movement of positioning the cap 30 on the tube head 3. This positioning, also referred to as capping, is carried out in particular on production lines. It is therefore important to allow a simple, reliable and repeatable kinematics to limit the production incidents. Advantageously, when the cap 30 is positioned on the tube head 3, on the production lines, the cap 30 is guided on the neck 10 along a guide path 21, along which it is simultaneously pushed towards the tube head and rotated counterclockwise.

When the cap 30 is in waiting position on the neck 10, the punch 7 is held at a distance from the lid 5. Said cap 30 is in this waiting position at the end of the initial positioning movement of the cap 30 on the tube head 3. This is the position in which the assembly is sold before filling the tube. It is also in this waiting position that the assembly is sold to the consumer, after the tube has been filled. Such an assembly provides a hold in the waiting position without the use of an additional piece such as a spacing ring.

As illustrated in FIGS. 15, 16 and 19, when the cap 30 is in the closing position, said punch 7 has perforated said lid 5. The cap 30 then hermetically seals the tube on which the assembly is adapted. The closing position can also be referred to as the position of use insofar as the cutting of the lid 5 determines the starting point of the use of the tube on which the closure assembly 1 according to the invention is mounted. In particular, the cap 30 may be intended to remain in the closing position. This is in particular the case when the punch 7 is in the form of a hollow barrel and has an opening, not shown, at the level of the upper face of the cap 30. Thus, once the cap 30 is in the closing position on the neck 10, the access to the internal volume of the tube on which the assembly is adapted is possible through said opening. According to an embodiment not shown, the opening of the neck 30 is closed by a cover connected to the cap 10, the cap and the cover optionally forming a service cap. Thus, the cap 30 can be held in closing position on the neck 10 while allowing the access to the internal volume of the tube and the closing of this access.

In addition to said guide path 21, said assembly comprises a threading 22 and a thread portion 11 allowing a positioning of the cap 30 on the neck 10 by cooperation with the guide path 21 and the threading 22. The guide path 21 and threading 22 are most particularly visible in FIGS. 1 to 4, while the thread portion 11 is most particularly visible, in transparency, in FIGS. 5 to 16.

As more particularly illustrated in FIGS. 5 and 6, when guiding from the initial position to the waiting position, said thread portion 11 cooperates with the guide path through a front end 12 of said thread portion 11.

As more particularly illustrated in FIGS. 11 to 16, said thread portion 11 is intended to cooperate with said threading 22 by screwing.

Said cap comprises a lateral skirt 23 having an inner face at the level of which said thread portion 11 is located. Said thread portion 11 has a substantially trapezoidal cross-section, intended to cooperate with the threading 22. Said thread portion 11 extends longitudinally along the axis A, radially inwardly of the cap 30 from the skirt 23 and angularly between its front end 12 and a rear end 13. The angular span of said thread portion is, for example, between 30 and 90°.

According to a first aspect of the invention, said assembly comprises a first stop 24 and a second stop 25 for said thread portion 11. Said stops are angularly spaced and define a passage 26 between the guide path 21 and the threading 22. Said assembly is configured to allow axial displacement of the thread portion 11 through the passage 26. Furthermore, once said thread portion 21 has passed through said passage 26, at least one of said stops, here the first stop 24 is configured to prevent a return of said thread portion 21 through said passage 26. The cap 30 is then blocked on the neck 10 by snap-fit and can no longer be released from the neck 10.

Such a kinematics allows to clearly identify the arrival in the waiting position by modifying the trajectory of the cap 30 which passes here from a movement including a rotation along the guide path 21 to an axial movement to cross said passage 26 rather than a kinematics according to which the arrival in the waiting position is done in the continuity of a screwing. Furthermore, the neck 10 has an outer partition 14 which remains smooth without a rib or groove at the level of said passage 26, the snap-fit effect of said thread portion 11 being solely due to the angular span of said passage 26, which is selected to be smaller than a span of said thread portion 11. The precision of such dimensions is more easily controlled than a radial dimension and may be less than a tenth of a millimeter, in particular in the case of an injection molding of said tube head 3 and/or said cap 30.

In the illustrated embodiment, said cap is in said waiting position after passing through said passage 26. In other words, said guide path 21 allows the passage from the initial position to the waiting position and said threading 22 allows the passage from the waiting position to the closing position.

Advantageously, one of the two between the guide path 21 and the threading 22 induces a screwing in a clockwise direction of rotation of the cap 10, the other of the two between the guide path 21 and the threading 22 inducing a screwing in a counterclockwise direction of rotation of the cap 10. Here, the guide path 21 induces counterclockwise rotation of the cap 10 and the threading 22 induces clockwise rotation of the cap 10.

Preferably, the neck 10 comprises the guide path 21 as well as the threading 22 while the cap 30 comprises the thread portion 11.

Here, the first stop 24 forms one end of said guide path 21. Said assembly further comprises a shoulder 27 connecting an origin of a first thread 28 of the threading 22 and the first stop 24. Thus, the origin of the first thread 28 and the first stop 24 are axially spaced apart. In particular, the first stop 24 forms a rounding joining said guide path 21 and said shoulder 27.

The second stop 25 is formed, for example, by an axial partition. The second stop 25 forms the origin of a second thread 29 of the threading 22.

Said second thread 29 advantageously forms a low axial stop when said thread portion 11 passes through said passage 26.

Preferably, said assembly comprises a third stop 31 configured to block a screwing of the cap 30 after the cap 30 has been positioned on the neck 10 and more precisely, here, when said cap 30 is in waiting position.

In other words, in waiting position, the thread portion 11 is blocked axially upwards by the first stop 24 and downwards by the second thread 29, unscrewing by the second stop 25 and screwing by the third stop 31.

In FIGS. 7 and 8, the thread portion 11 is crossing the passage 26, while in FIGS. 9 and 10, said thread portion 11 is positioned between the various stops mentioned in the previous paragraph.

Said third stop 31 comprises, for example, a wall 32, extending transversely from a bottom partition of the threading 22. Said wall 32 here has a constant thickness. Said assembly has a sharp angle between the wall 32 and the second thread 29. Said wall 32 extends radially between a bottom of the threading 22 and a free distal edge and axially between said second thread 29 and a free radial edge. Preferably, said wall 32 extends axially partially through said threading 22. The axial extension of said wall 32 allows to adjust the torque required to pass said third stop 31.

Preferably, an angular extension between the second 25 and the third 31 stops is just greater than an angular extension of the thread portion 11. Said third stop 31 is positioned here under said first thread 28, being slightly angularly offset from said first stop 24 in the screwing direction.

Said guide path 21 is formed, for example, by a third thread ending on the first stop 24.

Once said third stop 31 is passed, said thread portion 11 is configured to slide by screwing between the first 28 and the second 29 threads.

In the further movement of the cap 30, said neck 10 and said cap 30 are configured to guide the cap 30 on the neck 10, here by screwing, to the closing position through an intermediate position, illustrated in FIGS. 13 and 14, in which the punch has finished piercing said lid 5. In the case where, as illustrated, the punch 7 comprises a plurality of teeth 50, said intermediate position is the position occupied by the punch 7 when all the teeth 50 have pierced said lid 5.

Furthermore, as already mentioned, said neck 10 and said cap 30 are configured so that the guiding, in this case the screwing, of the cap 30 onto the neck 10 causes a deformation of the material making the closure tight.

According to a second aspect of the invention, said assembly is configured so that the passage through the intermediate position takes place prior to the deformation of the material sealing the closure. Such a configuration is obtained by the choice of the axial dimensions of the punch 7 and neck 10. Such sequencing allows to avoid the need to provide a too high torque compared to a configuration in which a seal would begin before the end of the piercing. The seal can be performed when the lid 5 is cut, after the piercing is complete. It was indeed found by the applicant that the torque required for the cutting is much lower than that for the piercing.

Advantageously, said cap 10 and said neck 30 are configured so that said intermediate position is located downstream of the waiting position according to the direction of guiding, in particular screwing, the cap 30 to the closing position. In other words, in the example illustrated in relation to the first aspect of the invention, said assembly is configured so that said thread portion 11 has passed said third stop 31 before the piercing of the lid begins.

Taking FIGS. 11 and 12 and FIG. 17 together, it can be seen that the punch 7 comes into contact with the lid 5 while the thread portion 11 is still interacting with the third stop 31. However, the piercing of the lid 5 does not begin immediately after the screwing movement. Indeed, the lid 5 is elastic so that it is deformed before being pierced. Thus, the piercing only begins in a position between that shown in FIGS. 11 and 12 and that shown in FIGS. 13 and 14.

Advantageously, as will be developed below in connection with the third aspect of the invention, said assembly further comprises a non-return stop 33 configured to prevent the cap 30 from moving out of the closing position. Even more advantageously, said assembly is configured so that said non-return stop 33 is passed by the cap 10 after passing to intermediate position. In other words, as illustrated in FIGS. 13 and 14, said cap 10 does not yet cooperate with said non-return stop 33 when the cap 10 is in said intermediate position.

The sealing of the closure can be achieved in different ways. In this case, the seal is obtained by cooperation of an inner partition of the neck 10 and an outer partition of the punch 5.

As illustrated in FIGS. 17 to 19, said punch 7 comprises a base 34 having an outer cylindrical portion 35 and said neck comprises an inner cylindrical portion 36, said inner 36 and outer 35 cylindrical portions being intended to be crushed against each other to achieve sealing of said closure. In this way, a cylinder-to-cylinder seal is achieved, which has the advantage of requiring less torque than that required for the compression of a seal that would be located on an upper free edge of the neck.

Said cap 30 herein comprises a top 37 from which said base 34 of the punch 7 extends. Said punch 7 further comprises an external chamfer 38 extending from said base 34 and connected to a distal part 39 of the punch 7. Said neck 10 comprises at its outwardly opening end an internal chamfer 40 extended axially by said portion 36 of the neck 10 against which the base 34 of the punch 7 is intended to be crushed.

In FIG. 17, upstream of the intermediate position, according to the screwing direction of the cap 30, it can be seen that the chamfer 38 of the punch is axially at a distance from the chamfer 40 of the neck. In FIG. 18, in said intermediate position, the chamfer 38 of the punch has just come to rest against the chamfer 40 of the neck. In FIG. 19, in the closing position, a compression of material has occurred between the base 34 of the punch and the corresponding portion 36 of the neck 10.

Advantageously, in order to limit the required torque, said distal part 39 of the punch has an outer diameter smaller than an inner diameter of the neck 10.

According to a third aspect of the invention, the lateral skirt 23 is provided with at least one notch 60 opening radially and said neck 10 comprises a protrusion 61 configured to cooperate angularly with said notch 60 to block a withdrawal of the cap 30, once said cap is in said closing position. Said protrusion 61 forms the aforementioned non-return stop 33.

Such a non-return stop 33 has the advantage that it is not located in the threading 23. It is therefore not susceptible to be damaged by the thread portion 11 during the passage of the latter to the closing position. In other words, in the illustrated embodiment, said thread portion 11 reaches said closing position by passing away from said protrusion 61.

Preferably, said notch 60 is open at a free edge of said skirt 23 so as to impart a radial elasticity to the cap 30 in the vicinity of said notch 60. Such elasticity has many advantages. Firstly, it limits the torque required to reach the closing position by overcoming said non-return stop 33. In addition, it facilitates an axial demolding of the thread portion 11. The notch 60 is, for example, substantially rectangular.

Advantageously, said protrusion 61 is configured to radially spread said skirt 23 before arrival of the cap 30 in the closing position. For this purpose, herein, said protrusion has an edge provided with an inclined portion 62 and a straight portion 63. Said straight portion 63 axially extends the inclined portion 62 toward a base of the neck 10. Said inclined portion 62 is configured to radially spread said cap 10 by pressing on a free edge of said skirt 23 before the cap 10 reaches the closing position. Said straight portion 63 is located at the level of a part of the protrusion 60 forming the non-return stop 33 for the cap 10 once in the closing position. More precisely, the notch 60 has an axial edge 64 bearing against a flank of said protrusion 33, the latter forming said non-return stop 33.

The protrusion 61 is formed, for example, by a wall extending radially from the outer partition 14 of the neck. Said wall has an upper free edge 65 terminating the second thread 29. Said protrusion 61 extends axially from the terminal end 65 of said second thread 29, here forming a lower thread of the threading 22, to the base of the neck 10. Said non-return stop 33 is intended to cooperate with the rear end 13 of the thread portion 11.

Advantageously, said assembly further comprises a stop 70, in particular angular, for the end of stroke of the cap 10 in the closing position. Said end of stroke stop 70 is configured to cooperate with said thread portion 11, once said protrusion 61 is engaged in said notch 60. Said end of stroke stop 70 is intended to cooperate with the front end 12 of the thread portion 11. Said return stop 70 here extends axially between the first thread 28 and the base of the neck.

In the illustrated embodiment, said assembly comprises a plurality of said thread portions 11 and a corresponding plurality of said threadings 22, in this case three, spaced at 120°. Said assembly further comprises a plurality of said notches 60 and a corresponding plurality of said protrusions 61, herein three, each of the thread portions 11 being angularly located between two adjacent ones of said notches 61. Said lateral skirt 23 thereby has flaps having a good radial flexibility between said notches 60, said thread portions being located at the level of said flaps.

In this configuration with various threadings 22, the first thread 28 of one of the threadings forms the second thread 29 of the adjacent threading 22.

In the upper part, the second stops 25 extend axially between an origin of the third thread forming the guide path 21 associated with one of the threadings 22 and the second thread 29 of the adjacent threading 22 in the clockwise direction.

In the lower part, the end of stroke stop 70 of one of the threadings 22 is located angularly, clockwise, just upstream of the protrusion 60 of the adjacent threading 22 in the counterclockwise direction. The first thread 28 of one of the threadings 22 continues into an end portion of the second thread 29 of the adjacent threading 22 in a counterclockwise direction.

As illustrated in FIGS. 17 to 20, the or said teeth 50 are advantageously configured to pierce and then cut said lid 5. The or said teeth 50 extend from a free edge 80 of the punch 7.

According to a fourth aspect of the invention, at least one angular portion 81 of said free edge 80, referred to as the passage portion, is configured to remain in the neck 10 in said closing position as is more particularly apparent from FIG. 19. Such a configuration improves the rate of restitution of the product contained in the tube by allowing a fraction of the product located in the vicinity of a shoulder 4 of the tube head 3 to circulate in the neck 10 at the level of said passage portion 81. Advantageously, said passage portion 81 is flush with a lower end of the neck 10 opening into the interior volume of the tube.

Here, said teeth 50 are distributed over an angular portion 82 of the punch 7, referred to as the cutting portion, delimited by two of said teeth 50 located angularly on either side of said cutting portion 82. Said passage edge 81 is formed by an angular portion of the punch complementary to said cutting portion 82.

As is better illustrated in FIG. 20 where a fictitious plane P extending orthogonally to said longitudinal axis A has been shown, said teeth 50 have tops 51 axially offset from each other. Such a configuration allows to limit the screwing torque by ensuring that the teeth 50 pierce the lid 5 successively. The axial offset of the top of the teeth 50 increases, in particular regularly, and even more particularly linearly, in a direction of displacement of the cap 10 towards said closing position, in other words, here, according to the screwing direction or clockwise direction (which corresponds to a counterclockwise direction in FIG. 20 since the latter is reversed). Thus, the tooth 50 located at a terminal end of the cutting portion 82 in the clockwise direction (counterclockwise in FIG. 20) has the most protruding top and meets the lid 5 first.

According to a fifth aspect of the invention, said teeth 50 have a substantially identical height and extend axially from an angular portion of the free edge of the punch 7 having an axial offset from one tooth 50 to the other. To that end, here, said free edge in said cutting portion 82 is in the form of a ramp of increasing height in the clockwise direction (counterclockwise in FIG. 20). Such an identical height of the teeth allows to limit their risk of breakage compared to a configuration in which one would meet teeth of too small sizes.

As illustrated, said teeth 50 preferably have a substantially identical profile. This is, for example, a profile with a leading edge 52 extending substantially axially between said free edge 80 and each top 51 and a return edge 53 extending in an inclined manner between each top 51 and said free edge 80. Said tops 51 are here formed at the junction of the leading edge 52, the return edge 53, an outer flank 54 of the tooth and an inclined surface 55 formed in the thickness of the teeth 50.

In addition to the assembly shown in the preceding figures, said tube according to the invention comprises a skirt 102, partially illustrated, connected to said tube head 3.

The invention claimed is:

1. An assembly for closing a tube, said assembly comprising:

a tube head that has a neck and a lid closing said neck; and a cap provided with a punch adapted to perforate said lid, said neck and said cap being configured to guide the cap to a closing position in which said punch has perforated said lid, said punch comprising a cutting portion and a passage portion, the cutting portion being an angular portion of a free edge of the punch on which teeth for cutting the lid and extending from the free edge of the punch are distributed, the cutting portion being delimited by two of said teeth located angularly on either side of said cutting portion, the passage portion being another angular portion of the free edge of the punch complementary to the cutting portion, the passage portion being without teeth and delimited by the two teeth located angularly on either side of the cutting portion, wherein an angular span of the passage portion is less than 180°, wherein, in the closing position, the passage portion remains in the neck and at least one of the teeth of the cutting portion protrudes into the tube.

2. The assembly according to claim 1 wherein said passage portion of the free edge of the punch is flush with a lower end of the neck.

3. The assembly according to claim 1 wherein said teeth have tops axially offset from one another.

4. The assembly according to claim 3, wherein the axial offset of the tops of the teeth is increasing in a direction of displacement of the cap towards said closing position.

5. The assembly according to claim 3 wherein said teeth have a identical height and extend axially from an angular portion of the free edge having an axial offset from one tooth to another.

6. The assembly according to claim 5, wherein said teeth have a identical profile.

7. The assembly according to claim 1, wherein said lid is located at the lower part of the neck.

8. The assembly according to claim 1, wherein said cap is screwed onto said neck over at least part of its stroke.

9. The assembly according to claim 1, wherein said cap comprises a service cap.

10. A tube comprising a closure assembly comprising a tube head that has a neck and a lid closing said neck, said assembly further comprising a cap provided with a punch adapted to perforate said lid, said neck and said cap being configured to guide the cap to a closing position in which said punch has perforated said lid, said punch comprising one or more teeth for cutting the lid extending from a free edge of the punch, at least one passage portion comprising an angular portion of said free edge being configured to remain in the neck in said closing position, wherein the one or more teeth are distributed over an angular portion of the punch, referred to as a cutting portion, delimited by two of said teeth located angularly on either side of said cutting portion, said passage portion being formed by an angular portion of the punch complementary to said cutting portion.

* * * * *